US008162730B2

(12) United States Patent
Reynard

(10) Patent No.: US 8,162,730 B2
(45) Date of Patent: Apr. 24, 2012

(54) VENTILATOR FOR FREIGHT CONTAINER

(75) Inventor: Kenneth Reynard, Thirsk (GB)

(73) Assignee: Duraloc Limited, Thirsk (GB)

( * ) Notice: Subject to any disclaimer, the term of this patent is extended or adjusted under 35 U.S.C. 154(b) by 1021 days.

(21) Appl. No.: 12/117,088

(22) Filed: May 8, 2008

(65) Prior Publication Data

US 2008/0280553 A1 Nov. 13, 2008

(30) Foreign Application Priority Data

May 10, 2007 (GB) ..... 0708992.3

(51) Int. Cl.
*B60H 1/00* (2006.01)
*F16K 24/04* (2006.01)

(52) U.S. Cl. ..... 454/118; 137/202

(58) Field of Classification Search ..... 454/251, 454/118; 220/1.5, 676, 1, 5; 137/179, 202, 137/199, 388, 1
See application file for complete search history.

(56) References Cited

U.S. PATENT DOCUMENTS

| | | | | |
|---|---|---|---|---|
| 4,495,857 | A | 1/1985 | Morgan | |
| 4,580,592 | A * | 4/1986 | Clark et al. | 137/172 |
| 6,119,712 | A * | 9/2000 | Schiebold | 137/202 |
| 6,994,103 | B2 * | 2/2006 | Takahashi et al. | 137/202 |
| 2002/0017520 | A1 * | 2/2002 | Smith | 220/210 |

* cited by examiner

*Primary Examiner* — Steven B McAllister
*Assistant Examiner* — Helena Kosanovic
(74) *Attorney, Agent, or Firm* — Kirton McConkie; Evan R. Witt

(57) ABSTRACT

A ventilator device for a freight container configured to prevent the ingress of water into the cargo tank interior. The ventilator device comprises a floatation-based valve configured to shuttle backwards and forwards in response to contact with water. The valve acts to open and close the air flow passageway through the device and is mounted over the air flow vents of the container. A manual override actuator may be provided to manually open and close the valves.

10 Claims, 2 Drawing Sheets

VENTILATOR FOR FREIGHT CONTAINER

BACKGROUND OF THE INVENTION

The present invention relates to a ventilator for a freight container, and in particular, although not exclusively, to a ventilation system for a shipping container.

Freight containers are widely used to transport goods over land, by air or sea. The freight containers are typically cuboidal steel containers with doors provided at one face to provide access to the container interior for goods storage and removal.

As the containers are used to transport a variety of different cargos, it is typically required to provide adequate ventilation to the container interior. Accordingly, most containers comprise vents positioned at the upper or lower corners of the two largest side faces. Conventional vent systems may simply comprise a number of perforations through the wall of the container through which air may flow to provide ventilation of the container interior.

Where such containers are transported by sea, a problem exists with conventional containers in that when the sea is rough it is possible for water to pass over the ship's hull to come in contact with the container and flow into the container interior via the open vents. This leads to both spoiled goods and possible corrosion of the container's interior.

What is required is a ventilation system for a transportation or freight container that addresses the above problems.

Accordingly, the inventors provide a ventilator device configured for positioning at the vent of a freight container to prevent the ingress of water into the freight container interior in the event of water coming into contact with the freight container exterior and in particular the container vent.

BRIEF SUMMARY OF THE INVENTION

According to a first aspect of the present invention there is provided a ventilator device for a transportable freight container, the device comprising:

a main body for positioning over an airflow vent formed in the external surface of a freight container;

a first compartment region positioned at said main body comprising an air outlet to allow air flow communication between the first compartment region and the vent of the freight container;

a second compartment region positioned at the main body comprising an air inlet to allow air flow into the second compartment region;

a partition means to separate the internal fluid communication between the first compartment region and the second compartment region, the partition means comprising at least one aperture to allow air flow communication between the first compartment region and the second compartment region; and a float housed within the second compartment region configured to shuttle back and forth against the aperture;

wherein the float is configured to move in to engaging contact with the aperture of the partition to prevent fluid from flowing from the second compartment region to the first compartment region and in to the interior of the freight container.

Preferably, the device comprises a manual actuator connected to the float to provide manual control of the position of the float within the second compartment region and to move the float in contact with the aperture to prevent fluid flow through the device. The manual actuator may comprise a lever positioned at an external region of the second chamber. The lever may be shaped and configured to be grasped by the fingers or thumb of a person to allow manual actuation.

Preferably, the air inlet at the second compartment region may comprise a plurality of holes or perforations through which a fluid may flow.

Preferably, the main body is formed by a unitary piece of material being shaped and configured to define a cavity or trough. The partition may extend within the cavity or trough to define the first and second compartment regions positioned adjacent to one another within the cavity. The first and second compartment regions may be closed by a backing plate formed integrally or non-integrally with the main body. Optionally, the first and second compartment regions may be open and enclosed only when the device is positioned against the external surface of the freight container. Where the device comprises a backing plate, suitable apertures or holes may be provided at the first compartment region to allow air flow communication to the underlying vent of the freight container. Where the device does not comprise a backing plate no such holes or perforations are required as the first compartment is provided in open fluid communication over the vent of the freight container.

Optionally, the ventilator device is formed as a box defining an internal chamber. The internal chamber is divided into the first and second compartment regions by a baffle-like partition comprising one or a plurality of apertures. One or a plurality of floats may be positioned in the second compartment region to shuttle back and forth against the internal baffle to provide an 'open' or 'closed' valve state of the ventilator device allowing or preventing air flow through the device and into the freight container interior, respectively. Accordingly, the ventilator box may comprise perforations, holes or a mesh provided at the first and second compartment regions. The perforations or mesh at the first compartment region are configured to be positioned over the vent formed in the side wall of the freight container whilst the perforations or mesh formed in the side wall of the second compartment region allow air flow into the ventilator device.

Preferably, the float comprises seal means to seat against the aperture of the internal baffle to provide a fluid tight seal between the first and second compartment regions when the float is in the closed position. Alternatively, the seal means may be provided at the aperture of the internal baffle for seating against the float when located in the closed position.

According to a second aspect of the present invention there is provided a transportable freight container comprising a ventilator device as disclosed herein.

According to a third aspect of the present invention there is provided a transportable freight container comprising:

an air flow vent formed in at least one of the walls of the container;

a vent mounting positioned over the air flow vent, the vent mounting comprising:

a first compartment region comprising an air outlet to allow air flow communication between the first compartment region and the vent of the freight container;

a second compartment region comprising an air inlet to allow air flow into the second compartment region;

a partition means to separate the internal fluid communication between the first compartment region and the second compartment region, the partition means comprising at least one aperture to allow air flow communication between the first compartment region and the second compartment region; and a float housed within the second compartment region configured to shuttle back and forth against the aperture;

wherein the float is configured to move in to engaging contact with the aperture of the partition to prevent fluid from flowing from the second compartment region to the first compartment region and in to the interior of the freight container.

The present ventilator device comprises a fluid control valve having both automatic and manual control functionality. According to an automatic mode of operation, the valve is controllable in response to contact of the device with water and in particular the ingress of water into the internal chamber of the device. The internal valve mechanism is designed to close the air flow communication through the device and into the interior of the cargo tank automatically in the event of flooding in the region of the cargo tank and in particular its vents.

According to a forth aspect of the present invention there is provided a ventilator device for a transportable freight container, the device comprising:

a main body defining an internal chamber;

a baffle positioned within the internal chamber to define a first compartment and a second compartment in fluid communication via the baffle;

a shuttle body housed within the second compartment capable of shuttling back and forth in contact with the baffle;

a fluid inlet positioned at the second compartment and a fluid outlet positioned at the first compartment.

BRIEF DESCRIPTION OF THE DRAWINGS

A best mode contemplated by the inventors for carrying out the present invention will now be described, by way of example only and with reference to the accompanying drawings in which.

DETAILED DESCRIPTION OF THE INVENTION

Figure 1:
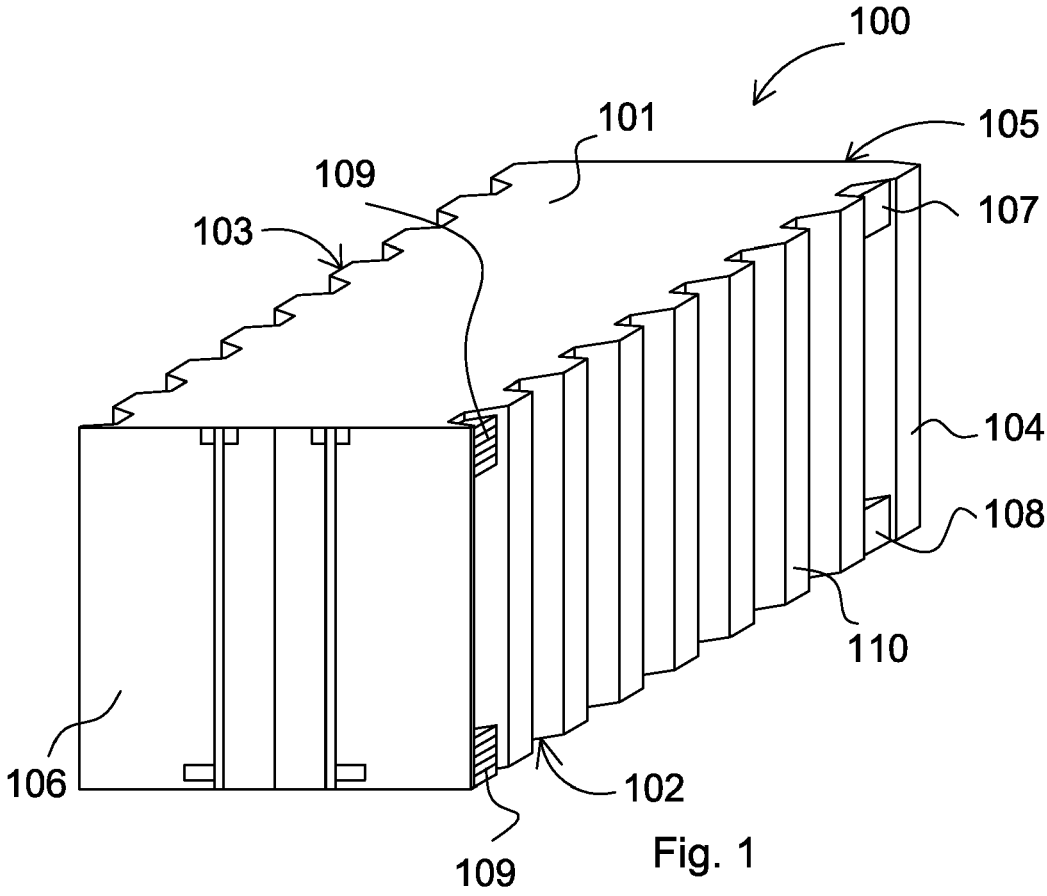
FIG. 1 is a perspective view of a transportable freight container comprising ventilator devices according to the present invention positioned over air flow vents formed in the side walls of the freight container according to a specific implementation.

Referring to FIG. 1, the freight container is substantially cuboidal comprising roof 101, floor 102, side walls 103, 104, 105 and doors 106 positioned opposed side wall 105. The side walls with the largest surface area 103, 104 comprise corrugations 110 extending vertically between roof 101 and floor 102. An air flow vent 107 is positioned at each uppermost corner of side walls 103, 104 to provide air flow into the interior of the container 400, referring to FIG. 4. Alternatively or in addition, a plurality of air flow vents 108 may be provided at each lowermost corner of container 100 on each of the largest faces 103, 104.

Container 100 comprises a ventilator device 109 positioned over the upper and/or lower air flow vents 107, 108. The ventilator device effectively covers the vents 107, 108 such that air flowing into the freight container interior 400 must pass through the ventilator device 109 interfaced with each air flow vent 107, 108.

Figure 4:
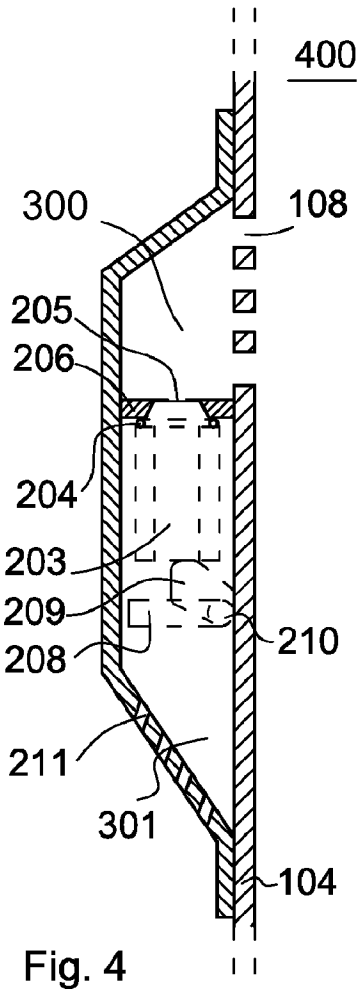
FIG. 4 is a cross sectional side elevation view through plane A-A of the ventilator device of FIG. 2.
Figure 3:
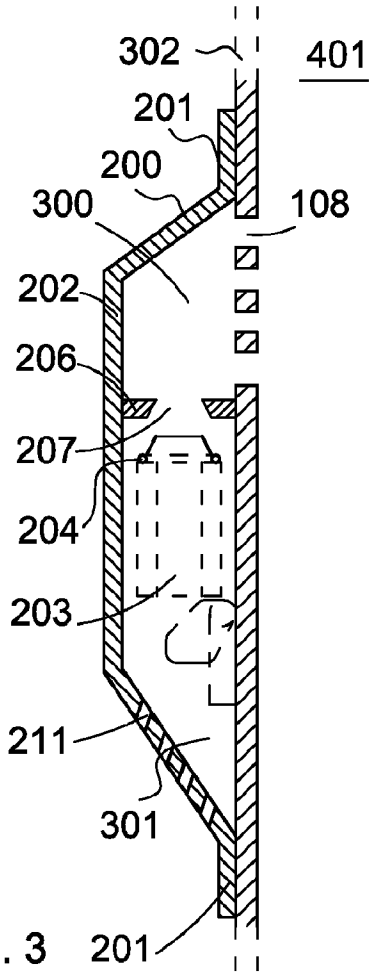
FIG. 3 is a cross sectional side elevation view through plane A-A of the ventilator device of FIG. 2.
Figure 2:
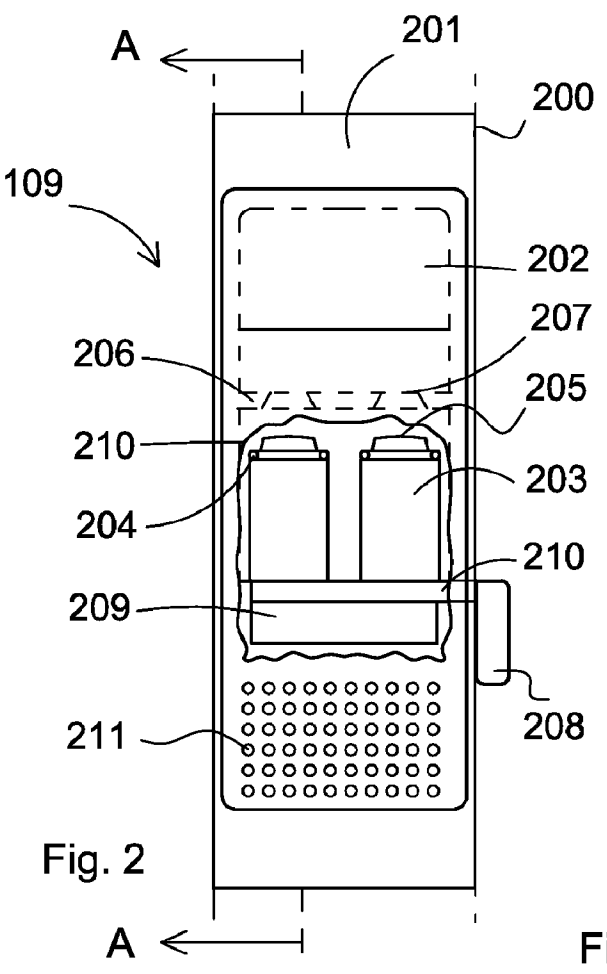
FIG. 2 is an external side elevation view of the ventilator device with part cut away section according to a specific implementation of the present invention.

Referring to FIGS. 2 to 4, the ventilator device 109 comprises a main body 200 configured for positioning in contact with an external surface 302 of side walls 103, 104. A flange 201 extends from main body 200 configured to mate with external surface 302. Flange 201 may be welded, riveted, or bolted to side walls 103, 104 using conventional techniques so as to mount ventilator device 109 in position over and about each air flow vent 107, 108 of freight container 100.

Main body 200 is shaped to define a trough or internal cavity/chamber region 202 relative to flange 201. Chamber region 202 is separated into a first compartment region 300 and a second compartment region 301 by a partition wall or baffle 206. In normal use, as illustrated in FIGS. 1 to 4, region 300 is located directly above region 301. First and second apertures 207 are formed within partition 206 to allow fluid communication between first and second compartment regions 300, 301. Referring to the cut away portion 210 of FIG. 2 and FIGS. 3 and 4, first and second floats 203 are housed within second compartment region 301. Each float 203 comprises an end region 205 configured to mate with the apertures 207 when floats 203 are moved into engagement with partition 206. A gasket or suitable O-ring 204 is positioned at each end region 205 of float 203 to provide a fluid tight seal when floats 203 are positioned as illustrated in FIG. 4.

The device comprises a fluid or valve actuator configured to provide manual control of the floatation based valve and in particular movement of the floats 203 back and forth within compartment 301 in engaging and disengaging position relative to partition 206 and in particular apertures 207. The manual actuator comprises a lever 208 coupled to an abutment shoulder 209 via a rotatable spindle 210. Shoulder 209 is positioned immediately below floats 203 and is configured, by movement of lever 208 and rotation of spindle 210, to contact the lowermost region of floats 203 so as to raise floats 203 in a vertical direction towards partition 206 illustrated in FIG. 4.

A plurality of holes 211 are formed through the side walls of compartment region 301 to provide a fluid communication pathway into the ventilator device 109. According to the specific implementation, the main body 200 encloses three sides of compartment regions 300, 301 with the remaining side being enclosed by the external facing surface 302 of container side walls 103, 104. According to further specific implementations, a backing plate (not shown) extends the full length between upper and lower flanges 201 to enclose compartment regions 300, 301. Where device 109 comprises a box configuration, including a backing plate, the backing plate comprises holes or other suitable means (e.g. a mesh) to allow air flow communication between first compartment region 300 and the interior 400 of container 100 via vents 107, 108.

In use, the ventilator device 109 positioned over each of the vents 107, 108 is configured to prevent liquid from passing from an external region 401 into the interior 400 of container 100. In normal use, floats 203 are housed within second compartment region 301 in spaced apart relationship relative to apertures 207. Accordingly, air is capable of flowing from external region 401 into interior 400 via holes 211, second compartment region 301, apertures 207, first compartment region 300 and through air flow vent 108 according to the 'open' valve configuration of FIG. 3.

In a valve 'closed' position illustrated in FIG. 4, air is prevented from flowing from second compartment region 300 and into first compartment region 301 as floats 203 are positioned to block apertures 207. Movement of floats 203 into the 'closed' position of FIG. 4 may be in response to liquid being introduced into the second compartment region 300, for example in the event of water contacting the outer surface of freight container 100. Alternatively or in addition, floats 203 may be moved into the 'closed' position by a user actuating lever 208 to raise floats 203 vertically to close-off apertures 207.

According to further specific implementations, the air flow inlet 211 may be formed as a mesh. Similarly, a mesh or perforated cover may extend over a part of the first compartment region 300 to sit against the air flow vents 107 of the freight container 100. As will be appreciated by those skilled in the art, the device may comprise one or a plurality of floats 203 and corresponding partitioning baffles 206, 207. Accordingly, the device may comprise a plurality of interconnected compartment regions arranged in series being separated by float closure mechanisms as illustrated in FIGS. 2 to 4 to define a plurality of floatation based valves provided in series to prevent the ingress of water into cargo tank interior 400. Where the device comprises a plurality of in-series float-based valves as detailed in FIGS. 2 to 4, each valve in the series may be controlled independently or collectively by one or a plurality of manual actuators 208, 209, 210.

The present ventilator device is shaped and comprises dimensions suitable for mounting and positioning within the recessed regions or troughs of the vertically extending corrugations 110 of side wall 103, 104 of freight container 100. Main body 200 may be formed from steel or any suitable metal material.

The invention claimed is:

1. A ventilator device for a transportable freight container, the device comprising:

a main body for positioning over an airflow vent formed in the external surface of a freight container;

a first compartment region positioned at said main body comprising an air outlet to allow air flow communication between the first compartment region and the vent of the freight container;

a second compartment region positioned at the main body comprising an air inlet to allow air flow into the second compartment region;

a partition means to separate the internal fluid communication between the first compartment region and the second compartment region, the partition means comprising at least one aperture to allow air flow communication between the first compartment region and the second compartment region;

a float housed within the second compartment region configured to shuttle back and forth against the aperture, the float configured to move in to engaging contact with the aperture of the partition to prevent fluid from flowing from the second compartment region to the first compartment region and in to the interior of the freight container; and a manual actuator connected to the float to provide manual control of the position of the float within the second compartment region and to move the float in contact with the aperture to prevent fluid flow through the device, wherein the manual actuator comprises a lever positioned external of the second compartment.

2. The device as claimed in claim 1 wherein the air inlet of the second compartment region comprises a plurality of holes.

3. The device as claimed in claim 1 wherein the first compartment region and the second compartment region are defined by the main body.

4. The device as claimed in claim 3 wherein the main body defines a cavity and the partition is positioned within the cavity such that the main body and the partition define the first and second compartment regions.

5. The device as claimed in claim 1 further comprising seal means provided at the float or aperture, the seal means configured to seat between the float and the aperture to provide a fluid tight seal between the first and second compartment regions.

6. A transportable freight container comprising a ventilator device as claimed in claim 1.

7. A transportable freight container comprising:

an air flow vent formed in at least one of the walls of the container;

a vent mounting positioned over the air flow vent, the vent mounting comprising:

a first compartment region comprising an air outlet to allow air flow communication between the first compartment region and the vent of the freight container;

a second compartment region comprising an air inlet to allow air flow into the second compartment region;

a partition means to separate the internal fluid communication between the first compartment region and the second compartment region, the partition means comprising at least one aperture to allow air flow communication between the first compartment region and the second compartment region; and a float housed within the second compartment region configured to shuttle back and forth against the aperture;

wherein the float is configured to move in to engaging contact with the aperture of the partition to prevent fluid from flowing from the second compartment region to the first compartment region and in to the interior of the freight container;

a manual actuator connected to the float to provide manual control of the position of the float within the second compartment region and to move the float in contact with the aperture to prevent fluid flow through the device, wherein the manual actuator comprises a lever positioned external of the second compartment.

8. A ventilator device for a transportable freight container, the device comprising:

a main body defining an internal chamber;

a baffle positioned within the internal chamber to define a first compartment and a second compartment in fluid communication via the baffle;

a shuttle body housed within the second compartment capable of shuttling back and forth in contact with the baffle;

a fluid inlet positioned at the second compartment and a fluid outlet positioned at the first compartment;

a manual actuator connected to the shuttle body to provide manual control of the position of the shuttle body within the second compartment and to move the shuttle body in contact with the baffle to prevent fluid flow through the device, wherein the manual actuator comprises a lever positioned external to the second compartment.

9. The device as claimed in claim 8 wherein the shuttle body is configured to move into contact with the baffle to provide a valve 'closed' state and to move away from the baffle to provide a valve 'open' state in which fluid is capable of flowing through the device and into an interior of the freight container.

10. A freight container comprising:

at least one air flow vent formed in at least one of the side walls of the container; and a ventilator device according to claim 8 mounted over the at least one air flow vent.

* * * * *